US006068492A

United States Patent [19]

Uratani et al.

[11] Patent Number: 6,068,492

[45] Date of Patent: May 30, 2000

[54] COAXIAL CONNECTOR HAVING SPRING MOVABLE CENTRAL PART

[75] Inventors: Chikara Uratani; Toshitaka Kuriyama, both of Ishikawa-ken; Yuichi Maruyama, Kanazawa, all of Japan

[73] Assignee: Murata Manufacturing Co., Ltd., Nagaokakyo, Japan

[21] Appl. No.: 09/229,159

[22] Filed: Jan. 13, 1999

[30] Foreign Application Priority Data

Jan. 13, 1998 [JP] Japan ..... 10-004883
Jul. 6, 1998 [JP] Japan ..... 10-190694

[51] Int. Cl.[7] ..... H01R 9/09

[52] U.S. Cl. ..... 439/63; 439/63; 439/188; 439/581

[58] Field of Search ..... 439/188, 63, 581, 439/187, 578, 579

[56] References Cited

U.S. PATENT DOCUMENTS 5,007,851 4/1991 Matsumoto ..... 439/188
5,108,299 4/1992 Cronin .
5,741,146 4/1998 Henry et al. ..... 439/188

FOREIGN PATENT DOCUMENTS 0 782 219 A1 7/1997 European Pat. Off. .
2 733 348 10/1996 France .
WO 95/30258 11/1995 WIPO .

*Primary Examiner*—Lincoln Donovan
*Assistant Examiner*—Truc Nguyen
*Attorney, Agent, or Firm*—Burns, Doane, Swecker & Mathis, LLP

[57] ABSTRACT

The present invention is to provide a coaxial connector capable of achieving secure and stable contact and connection, and realizing sufficiently small size and thin shape. A movable terminal has a movable mechanism part formed so as to have a spring movable function and a lead part, linked with the movable mechanism part, applied with the bending process into a U-shape. The movable mechanism part comprises a base part elongating from the lead part to both sides, two spring supporting parts formed at both end parts of the base part, a spring movable part elongating parallel with the base part between the spring supporting parts, and a contacting part formed projecting from the spring movable part. The spring movable part is supported and fixed at both ends by the spring supporting parts so as to form an arc-like shape with the center part bulged upward, and thus the contacting part can contact with the lower surface of the contacting part of the fixed terminal by the force derived from the spring property of the arc-like spring mechanism so that the fixed terminal and the movable terminal are contacted and connected.

13 Claims, 5 Drawing Sheets

FIG. 1
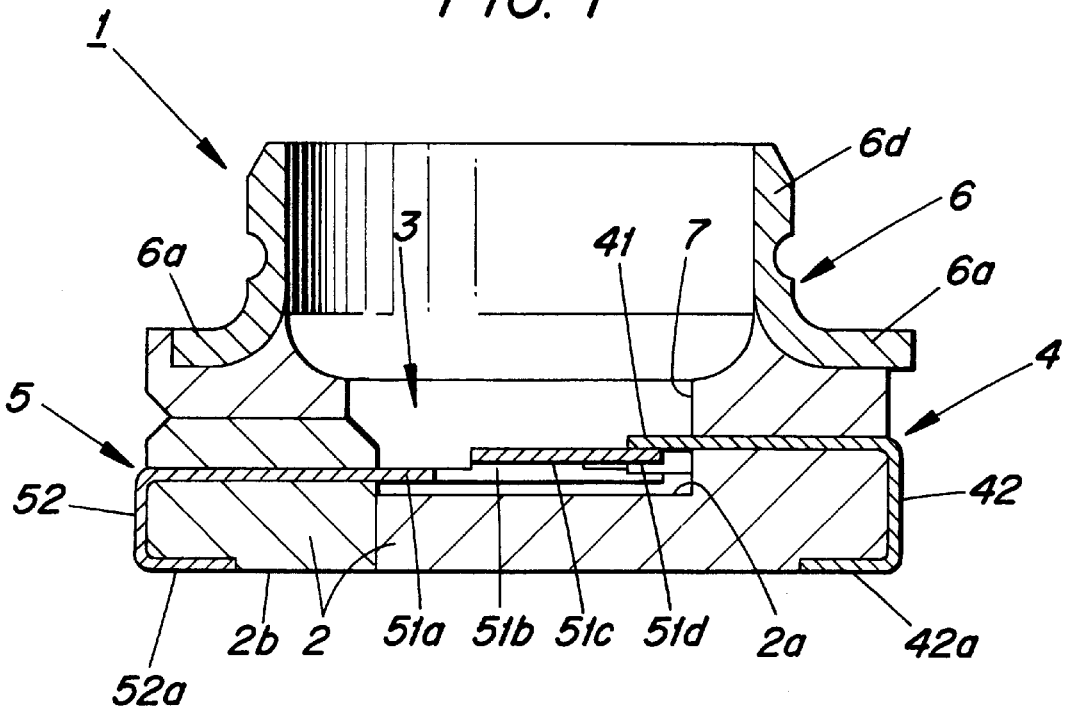
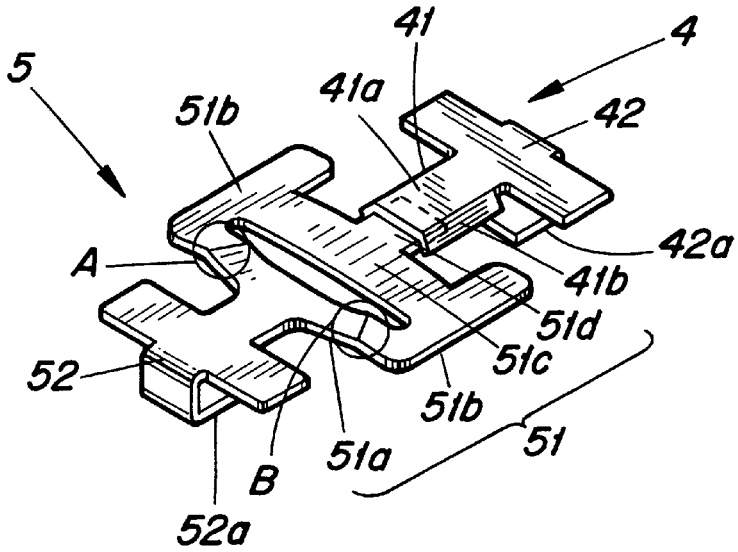
FIG. 2

FIG. 3
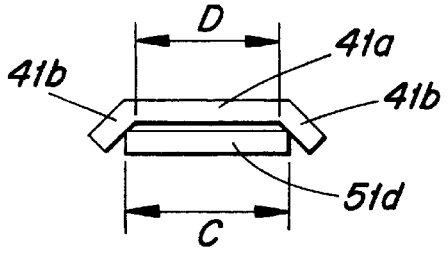
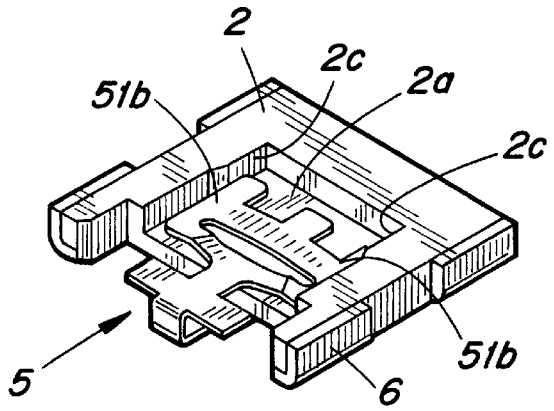
FIG. 4
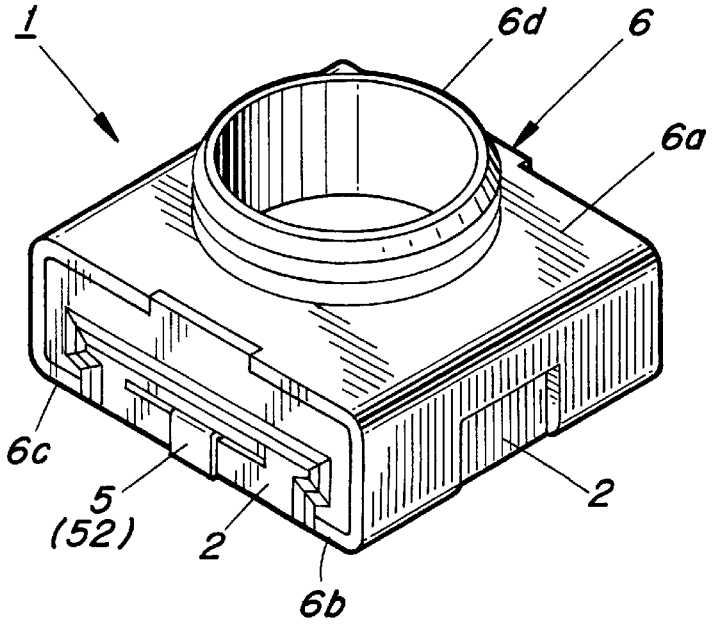
FIG. 5

FIG. 9
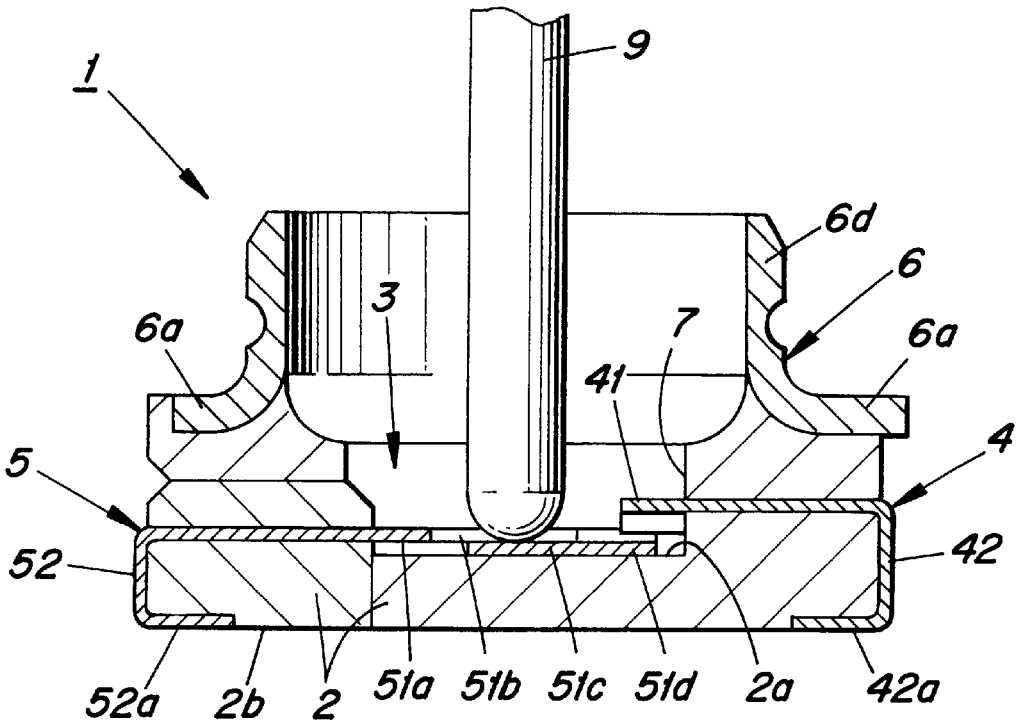
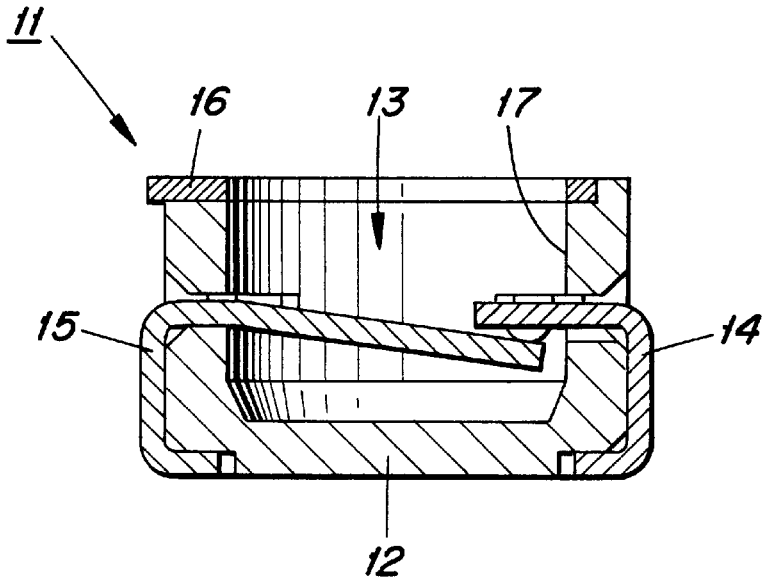
FIG. 10

COAXIAL CONNECTOR HAVING SPRING MOVABLE CENTRAL PART

This application is based on Japanese Patent Application No. 10-4883, filed on Jan. 13, 1998, and Japanese Patent Application No. 10-190694, filed on Jul. 6, 1998. Both of these applications are incorporated herein by reference in their entireties.

BACKGROUND OF THE INVENTION

1. Field of the Invention

The present invention relates to a coaxial connector to be used for portable small-size electronic devices, more specifically to a coaxial connector provided with a movable terminal and a fixed terminal in a case such that the movable terminal and the fixed terminal can be contacted or dissociated according to the attachment or detachment of the counterpart coaxial connector.

2. Description of the Related Art

As a conventional coaxial connector to be used for portable communication devices such as mobile phones, those having a configuration shown in FIGS. 10 and 11 are presented. The conventional coaxial connector 11 is provided with a metal fixed terminal 14 and a movable terminal 15 made of a metallic material having a spring property, in a concave part 13 of an insulating case having a rectangular parallelopiped shape 12, with an external terminal 16 provided for covering the main parts of the case 12. The fixed terminal 14 is provided so as to project substantially horizontally from a position above the inner bottom surface of the concave part 13 by a predetermined distance. The movable terminal 15 on the other end, which is formed by punching a metal plate and applying the bending process, is fixed partially to the side wall on the opposite side of the projecting position of the fixed terminal 14 with respect to the concave part 13, and provided substantially horizontally with the tip part contacting with the lower surface of the fixed terminal 14. The concave part 13 of the case 12 is an upright column-like space, with the upper side opened as a round introduction opening 17 so that the central contact of the counterpart coaxial connector can enter from the introduction opening 17 downward.

The movable terminal 15 contacts and connects with the fixed terminal 14 by its own spring property when the counterpart coaxial connector is not mounted. On the other hand, when the counterpart coaxial connector is mounted, it is pressed by the central contact introduced from the introduction opening 17 into the concave part 13 so as to dissociate from the fixed terminal 14 and contacts and connects with the counterpart central contact. Furthermore, when the counterpart coaxial connector is mounted, the external terminal 16 and the external conductor of the counterpart coaxial connector are contacted and connected.

However, in the above-mentioned conventional coaxial connector 11, the movable terminal 15 has a cantilever configuration where one end side is fixed and the other end side, which serves as the contacting part with respect to the fixed terminal 14, is movable. If an excessive load is applied when the counterpart coaxial connector is mounted, or by the repetition of mounting the counterpart coaxial connector, the spring function of the movable terminal 15 is deteriorated due to the plastic deformation of the movable terminal 15, and thus the stable contact and connection of the fixed terminal 14 and the movable terminal 15 after detaching the counterpart coaxial connector cannot be ensured. In some cases, there is a risk of being left open without having contact. In particular, deterioration of the spring function causes a serious problem since the terminal thickness is extremely thin in recent small-size coaxial connectors.

Moreover, since the movable terminal 15 has a cantilever configuration, even if the movable terminal and the fixed terminal are detached (dissociated) by the displacement of the movable terminal, it is difficult to feel the dissociation. Furthermore, if dusts is adhered on the terminal contacting parts of the movable terminal and the fixed terminal, there is a risk of causing contact failure between the terminals.

SUMMARY OF THE INVENTION

In order to solve the above-mentioned problems, an object of the present invention is to provide a coaxial connector, capable of having secure and stable contact and connection, and achieving sufficiently small size and thin shape.

Accordingly, a coaxial connector comprises:

an insulating case provided with a concave part for introducing a central contact of a counterpart coaxial connector, a fixed terminal and a movable terminal provided in the concave part of the case, projecting in the direction substantially perpendicular to the introduction direction of the central contact, and an external terminal provided outside the case for contacting and connecting with an external conductor of the counterpart coaxial connector when the counterpart coaxial connector is mounted, wherein the movable terminal has a spring movable part with both ends supported and the center part having the displaceable spring property, and a contacting part linked with the spring movable part integrally, and when the counterpart coaxial connector is not mounted, the contacting part is contacted and connected with the contacting part of the fixed terminal by being forced in the direction opposite to the introduction direction of the central contact by the spring property of the spring movable part, on the other hand, when the counterpart coaxial connector is mounted, the center part of the spring movable part is pressed onto the bottom surface side of the concave part by the central contact introduced into the concave part so that the contacting part is dissociated from the contacting part of the fixed terminal.

In the coaxial connector, the movable terminal comprises a metal plate, provided with spring supporting parts on both ends of the spring movable part, with the pair of the spring supporting parts linked at a base part formed parallel to the spring movable part, and the spring supporting parts embedded in the case so as to be fixed to the case.

In the coaxial connector, the spring movable part is formed in the arc-like curved state by the bend of the base part.

In the coaxial connector, the spring supporting parts are positioned by the inner wall surface of the concave part of the case.

In the coaxial connector, the contacting part of the fixed terminal has an inclined surface with respect to the contacting part of the movable terminal with a predetermined angle, and the contacting part of the movable terminal is linearly contacted with the inclined surface of the fixed terminal for sliding the same.

In the coaxial connector, the contacting part of the fixed terminal and the contacting part of the movable terminal are provided so as to project from positions substantially opposite to each other on the inner wall surface of the concave part of the case to a position away from the inner bottom surface of the concave part by a predetermined distance.

In the coaxial connector, the case has a substantially rectangular parallelopiped shape, lead parts are formed integrally with the movable terminal and the fixed terminal, with the lead parts bent around to a lower side of the case so as to form first connecting end parts substantially flush with a rear surface of the case, on the other hand, the external terminal is a plate-like member adhered to the case, having a substantially U-shaped cross-section with respect to the longitudinal direction, with the central flat part on an upper surface of the case provided with a through cylinder to be fitted with the external conductor of the counterpart coaxial connector for introducing the central contact into the concave part of the case, and bent parts provided on both sides of the central flat part are bent around to the lower side of the case on the outer surface of the side walls of the case so as to form second connecting end parts substantially flush with the rear surface of the case.

In the coaxial connector, the case and the terminals are formed integrally.

According to the coaxial connector of the present invention, since the movable terminal is provided with the spring movable part supported on both ends, a stronger spring force can be obtained and thus secure and stable contact and connection can be achieved. Furthermore, even if the counterpart coaxial connector is mounted repeatedly, or even if an excessive load is applied when the counterpart coaxial connector is mounted, deterioration of the spring function of the spring movable part can be reduced drastically compared with the cantilever type conventional one so that the spring function reliability of the movable terminal can be improved drastically.

Moreover, since the spring movable part is formed in the arc-like curved state by the bend of the base part, that is, a curved state is formed by bending a flat plate, not by the plastic deformation of the spring movable part, plastic deformation of the spring movable part can hardly be caused even when the counterpart coaxial connector is repeatedly mounted, and thus the reliability of the spring function of the spring movable part can further be improved. Besides, since the spring supporting parts, which are both end parts of the spring movable parts, are positioned and fixed by the inner wall surface of the concave part of the case, spread of the spring movable part can be prevented even when the counterpart coaxial connector is mounted so that the spring movable part can be reversed securely, click feeling by the reversal of the spring movable part can be obtained. That is, dissociation of the fixed terminal and the movable terminal can be confirmed easily.

Furthermore, since the contacting part of the fixed terminal has an inclined surface with respect to the contacting part of the movable terminal with a predetermined angle, and the contacting part of the movable terminal is linearly contacted with the inclined surface of the fixed terminal for sliding the same, even if a foreign substance such as dusts is adhered between the terminals, the foreign substance can be eliminated by the sliding function of the contacting parts, and thus secure contact and connection can be achieved. By having a contacting position at two spots, reliability in contact and connection can further be improved.

Moreover, since the movable part with a both ends supported configuration is formed integrally, and formed integrally with the case, the spring structure supported on both ends can be formed economically and the assembly accuracy can be improved.

Furthermore, since the movable terminal and the fixed terminal are provided opposite to each other, the movable terminal and the fixed terminal need not be provided with a vertical long distance, and thus a further thin shape can be achieved.

Since the connecting end parts of the movable terminal, the fixed terminal and the external terminal are provided substantially flush with the rear surface of the case, surface mount can be conducted easily.

Moreover, since the flat part of the external terminal is formed on the upper surface of the case, mount with an automatic mounting machine can be conducted easily.

Furthermore, since a through cylinder is formed on the upper surface of the external terminal, stable and secure connection with the counterpart coaxial connector can be achieved.

Moreover, since the terminals and the case are formed integrally, the case and the terminals can be assembled simultaneously with the production of the case and thus the production cost can be reduced.

BRIEF DESCRIPTION OF THE DRAWINGS

FIG. 1 is a cross-sectional view of a coaxial connector of an embodiment.

FIG. 2 is a perspective view of a fixed terminal and a movable terminal of the coaxial connector of the embodiment.

FIG. 3 is a diagram showing the cross-section of the contacting parts in the state where the fixed terminal and the movable terminal are contacted according to the embodiment.

FIG. 4 is a perspective view showing the state where the movable terminal is attached to the case according to the embodiment.

FIG. 5 is a perspective view showing the entire appearance of the coaxial connector according to the embodiment.

FIG. 9 is a cross-sectional view where the counterpart coaxial connector is mounted in the coaxial connector according to an embodiment.

FIG. 10 is a cross-sectional view of a conventional coaxial connector.

DESCRIPTION OF THE PREFERRED EMBODIMENTS

Figure 6:
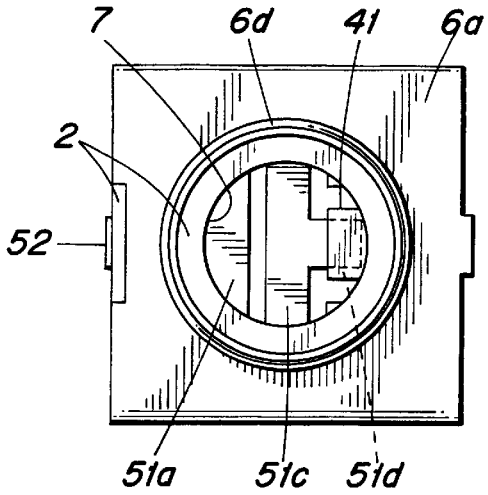
FIG. 6 is a plan view showing the upper surface appearance of the coaxial connector according to the embodiment.

Hereinafter features of embodiments of the present invention will be explained in further detail. FIG. 1 is a cross-sectional view of a coaxial connector, FIG. 2 is a perspective view showing the state where a movable terminal and a fixed terminal are provided in a case, FIG. 3 is a diagram showing the cross-section of connecting parts in the state where the movable terminal and the fixed terminal are contacted, FIG. 4 is a perspective view in the state where the movable terminal is attached on the case, FIG. 5 is a perspective view showing the entire appearance, and FIG. 6 is a plan view showing the upper surface appearance. In FIG. 4, the case is shown in the cut state, and FIGS. 1 to 6 show the state where the counterpart coaxial connector is not mounted.

A coaxial connector 1 according to this embodiment comprises a synthetic resin insulating case 2 having a rectangular parallelopiped shape, a metallic fixed terminal 4 and a movable terminal 5 made from a metallic material having a spring property provided in a concave part (internal space) 3 of the case 2, and an external terminal (external conductor) 6 provided so as to cover the main part of the case 2. The concave part 3 of the case 2 is a substantially upright prismatic space, having a roundly-opened introduction opening 7 on the upper side so that the central contact of the counterpart coaxial connector can enter from the introduction opening 7 downward.

The fixed terminal 4, which comprises a contacting part 41 to be the contacting point with the movable terminal and a lead part 42, linked with the contacting part 41, applied with a bending process in an U-shape, is formed by punching a flat plate-like metal plate with a bending process. The contacting part 41 is formed by bending both sides of a metal plate with a predetermined width substantially by 45 degrees so as to have a horizontal surface 41*a* and inclined surfaces 41*b*, 41*b* on both sides of the horizontal surface 41*a*. The contacting part 41 is provided so as to project substantially horizontally from a position above the inner bottom surface 2*a* of the concave part 3 formed in the case 2 by a predetermined distance. The lead part 42 extends along the outer surface of the side wall to the lower side of the case so as to have a connecting end part 42*a* substantially flush with the rear surface 2*b* of the case 2 at the tip part thereof. A part of the lead part 42 is widely formed, with the wide part embedded in the side wall of the case 2.

The movable terminal 5, comprising a movable mechanism part 51 provided so as to have a spring movable function, and a lead part 52 linked with the movable mechanism part 51, applied with a bend process into a U-shape, is formed by punching a metal plate having a spring property into a predetermined shape and applying a bending process.

The movable mechanism part 51 comprises a base part 51*a* extending in a direction perpendicular to the lead part 52, two spring supporting parts 51*b*, 51*b* extending parallel with the lead part 52 on both end parts of the base part 51*a*, a spring movable part 51*c* extending parallel with the base part 51*a* so as to connect the spring supporting parts 51*b*, 51*b*, and a contacting part 51*d* formed projecting from the center part of the spring movable part 51*c*.

The spring movable part 51*c* is formed in the arc-like curved state bulged upward. In order to form and maintain the curved state of the spring movable part 51*c*, the base part 51*a* is bent at two positions A, B so as to bulge the center part thereof downward. That is, the base part 51*a* is formed with the bent parts A, B for curving the spring movable part 51*c* and maintaining the curved state.

Accordingly, since the spring movable part 51*c* of the movable terminal 5 of this embodiment is not curved by the plastic deformation, but by bending a flat plate so as to maintain the curved state, the spring movable part 51*c* is only reversed in order to restore the original flat plate state when the counterpart coaxial connector is mounted to cause displacement, and thus the plastic deformation of the spring movable part 51*c* cannot be caused even if the counterpart coaxial connector is mounted repeatedly.

As shown in FIG. 4, terminal guide parts 2*c*, 2*c* having a size between the facing inner walls substantially the same as the size between the side end surfaces of the spring supporting parts 51*b*, 51*b* are formed at portions corresponding to the side end surfaces of the tip parts of the spring supporting parts 51*b*, 51*b* at the inner wall surfaces of the concave part 3 of the case 2. The movable terminal 5 is attached to the case 2 by placing the movable mechanism part 51 on a bottom surface 2*a* in the concave part 3 of the case 2 and holding the side end surfaces of the spring supporting parts 51*b*, 51*b* between the terminal guide parts 2*c*, 2*c* in the case 2. That is, the movable terminal 5 is positioned at the tip parts of the spring supporting parts 51*b*, 51*b* by the terminal guide parts 2*c*, 2*c* so as to be attached to the case 2, preventing the spread of the spring movable part 51*c* even when the spring movable part 51*c* is pressed downward as later described.

Accordingly, since the spring supporting parts 51*b*, 51*b* to be both end parts of the spring movable part 51*c* are positioned and fixed by the terminal guide parts 2*c*, 2*c* of the case 2 in this embodiment, click feeling by the reversal of the spring movable part 51*c* can be obtained when the counterpart coaxial connector is mounted, and thus dissociation of the fixed terminal and the movable terminal can be confirmed easily.

Moreover even if an excessive force is applied on the spring movable part 51*c* in mounting the counterpart coaxial connector, since the lowermost part of the spring movable part 51*c* contacts with the bottom surface 2*a* in the case 2, the spring movable part 51*c* cannot exceed a predetermined displacement amount and thus deformation of the spring movable part 51*c* can be prevented.

It is provided such that the fixed terminal 4 and the movable terminal 5 can be contacted and connected securely and stably by the contact of the contacting part 51*d* of the movable terminal 5 and the contacting part 41 of the fixed terminal 4 by the force (spring force) derived from the spring property of the spring mechanism curved like an arc of the spring movable part 51*c*.

More specifically, as shown in FIG. 3, the width C of the contacting part 51*d* of the movable terminal 5 is formed with a size larger than the width D of the horizontal surface 41*a* of the contacting part 41 of the fixed terminal 4 so that both ridgeline parts of the upper surface of the contacting part 51*d* of the movable terminal 5 and the lower surface of the inclined surfaces 41*b*, 41*b* of the contacting part 41 of the fixed terminal 4 can be contacted linearly. That is, in this embodiment, the contacting surfaces (inclined surfaces) 41*b* of the fixed terminal 4 with respect to the movable terminal have a predetermined angle with respect to the horizontal direction so that the contacting part 51*d* of the movable terminal 5 can slide the inclined surfaces 41*b* of the fixed terminal 4 vertically in the state where the movable terminal 5 is contacted with the contacting part 41 of the fixed terminal 4 by the above-mentioned spring force. In this embodiment, since a foreign substance can be eliminated by the sliding function according to the sliding structure of both terminal contacting parts even when the foreign substance such as dust is adhered between the terminals, secure contact and connection between the fixed terminal 4 and the movable terminal 5 can be achieved.

The movable terminal 5 has the movable mechanism part 51 extending substantially horizontally from a position opposite to the projecting position of the fixed terminal 4 with respect to the concave part 3. The contacting part 51*d*, which is the tip part, contacts with the lower surface of the contacting part 41 of the fixed terminal 4. The lead part 52 extends on the outer surface of the side wall around to the lower side of the case 2, with the tip part of the lead part 52 serving as the connecting end part 52*a* substantially flush with a rear surface 2*b* of the case 2. A part of the lead part 52 is formed widely, with the wide part embedded in the side wall of the case 2.

The external terminal 6 to be contacted with the external conductor of the counterpart coaxial connector is a plate-like member having a substantially U-shape in the cross-section in the longitudinal direction, formed by punching a metal plate for a spring such as phosphor bronze, and applying a bending process, a drawing process, and the like. A flat part 6*a* of the external terminal 6 in the center of the plate-like member is adhered on the upper surface part of the case 2. The Bent parts (leg parts) provided on both sides of the flat part 6*a* extends around to the lower side of the case 2 on the outer surface of the opposing two side walls, so as to serve as connecting end parts 6*b*, 6*c* substantially flush with the rear surface 2*b* of the case 2. Furthermore, a through cylinder 6*d* for fitting with the external conductor of the counterpart coaxial connector and introducing the central contact is formed at the flat part 6*a* so as to correspond with the introduction opening 7 of the case 2 and to be concentric therewith. The external terminal 6 usually serves as a ground and the outer surface of the external terminal 6 can be applied with plating as needed.

As mentioned above, the connecting end parts 42*a*, 52*a* of the terminals 4, 5 and the connecting end parts 6*b*, 6*c* of the external terminal 6 are formed substantially flush with the rear surface 2*b* of the case 2 so as to enable the surface mount. Moreover, the through cylinder 6*d* is formed in the external terminal 6 so that stable and secure connection with the counterpart coaxial connector can be achieved.

The coaxial connector 1 of this embodiment with a 3.0 mm length, a 3.0 mm width and a 1.75 mm height is produced with a 0.05 mm thickness SUS301, SUS304 or copper alloy for a spring as the fixed terminal 4 and the movable terminal 5. Further, the fixed terminal 4, the movable terminal 5 and the external terminal 6 are formed integrally with the case 2 by insert molding. More specifically, the case 2 comprises a part formed by insert-molding the fixed terminal 4 and the external terminal 6 and a part formed by insert-molding the movable terminal 5, fitted with each other. By forming the terminals 4, 5, 6 and the resin case 2 integrally, the assembly accuracy can be improved as well as the production cost can be reduced.

Figure 7:
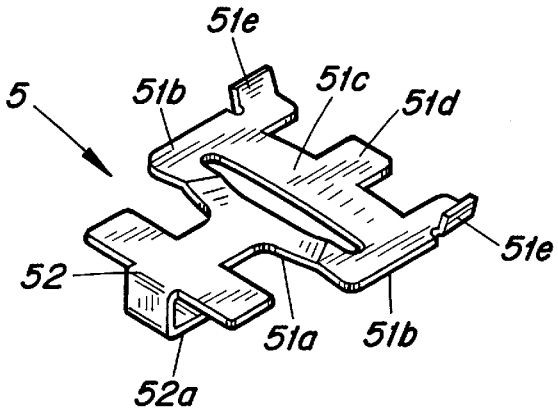
FIG. 7 is a perspective view of a movable terminal according to another embodiment.

In the above-mentioned embodiment, where the entire surface of the spring supporting parts 51*b* of the movable terminal 5 are formed like a flat plate, if the spring supporting parts 51*b* cut into the case by the external force depending on the material of the case 2, bent parts 51*e* as shown in FIG. 7 can be formed at a portion of the spring supporting parts contacting with the inner wall surface of the case 2. By adopting this structure, the cut-in of the spring supporting parts 51*b* into the terminal guide parts 2*c* of the case 2 can be prevented securely.

Figure 8A:
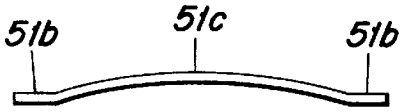
FIG. 8*a* & 8*b* is a diagram for explaining the spring function of a spring movable part of the movable terminal of the present invention.
Figure 8B:
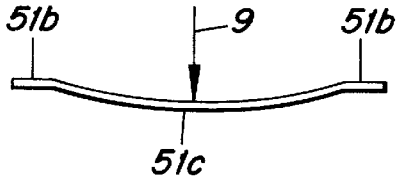
Figure 11:
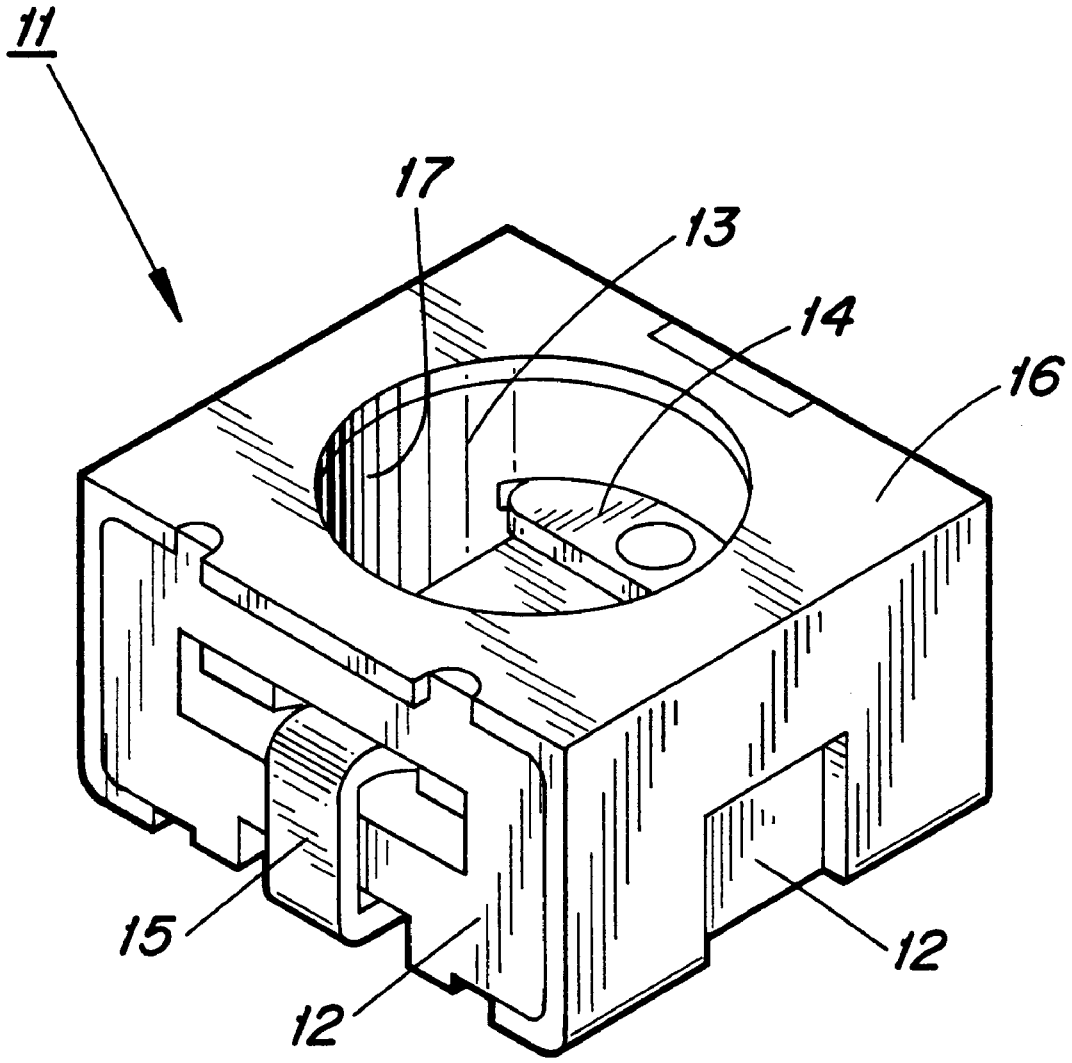
FIG. 11 is a perspective view showing the entire appearance of the conventional coaxial connector.

The operation of the coaxial connector of this embodiment will be explained with reference to FIGS. 8 and 9. FIG. 8A, 8B are diagrams showing the spring function of the spring movable part. FIG. 8A shows the state where the counterpart coaxial connector is not mounted, and FIG. 8B shows the state where the counterpart coaxial connector is mounted. FIG. 9 is a cross-sectional view where the counterpart coaxial connector is mounted, corresponding to FIG. 1.

In the coaxial connector 1 of this embodiment, the spring movable part 51*c* is supported and fixed at both ends. When the counterpart coaxial connector is not mounted, the spring movable part 51*c* is in the state with the center part bulged upward as shown in FIG. 8A, and when the counterpart coaxial connector is mounted, the center part is pressed downward and reversed by the central contact 9 of the counterpart coaxial connector so as to be in the arc-like state with the center part bulged downward. The spring property is that the center part restores the state with the center part bulged upward when the counterpart coaxial connector is removed in this state is provided. The contacting part 51*d* of the movable terminal 5 linked with the center part of the spring movable part 51*c* is provided so as to fluctuate according to the vertical movement of the spring movable part 51*c*.

That is, as shown in FIG. 1, when the counterpart coaxial connector is not mounted, the movable terminal 5 contacts with the fixed terminal 4 by the force of the spring property of the spring movable part 51*c* so that the terminals 4, 5 are connected electrically.

On the other hand, when the counterpart coaxial connector is mounted as shown in FIG. 9, the spring movable part 51*c* is pressed downward by the central contact 9 introduced from the upper through cylinder 6*d* and introduction opening 7 so that the contacting part 51*d* of the movable terminal 5 is dissociated from the contacting part 41 of the fixed terminal 4 so as to cut off the electric connection between the fixed terminal 4 and the movable terminal 5. On the other hand, the central contact 9 and the movable terminal 5 are connected electrically. At the same time, the external conductor (not illustrated) of the counterpart coaxial connector is fitted into the external terminal 6 so that the external conductor is connected electrically with the external terminal 6.

As heretofore mentioned, according to the coaxial connector 1 of this embodiment, since the spring movable part 51*c* with both ends supported is provided in the movable terminal 5, a stronger spring force can be obtained so as to achieve secure and stable contact and connection as well as when the counterpart coaxial connector is mounted repeatedly, or when an excessive load is applied in mounting the counterpart coaxial connector, deterioration of the spring function of the spring movable part 51*c* is reduced drastically compared with a conventional one with the cantilever configuration, and thus reliability of the spring function of the movable terminal 5 can be improved drastically. Moreover, since the fixed terminal 4 and the movable terminal 5 are linearly contacted at two portions and the contacting parts have the sliding function, reliability of the contact and connection of the terminal can be improved drastically.

Although the case 2 has a substantially rectangular parallelopiped shape and the concave part 3 has a substantially prismatic shape in the explanation of the above-mentioned embodiment, the shape of the case 2 and the concave part can be other shapes such as a columnar shape.

Although the case where the external terminal 6 and the case 2 are formed integrally has been explained in the above-mentioned embodiment, it is needless to say that the coaxial connector of this invention can be obtained by producing the case 2 and the external terminal 6 individually and assembling them.

Furthermore, the connecting end parts of the fixed terminal 4 and the movable terminal 5 and the connecting end part of the external terminal 6 can be a non-surface mount type, projecting from the case 2 but not flush therewith. Moreover, the movable mechanism part 51 and the lead part 52 of the movable terminal 5 can be produced individually and connected by welding, and the like.

Furthermore, in other aspects, it is not limited to the above-mentioned embodiment, but various application or modification can be adopted within the range of the gist of the present invention.

According to the coaxial connector of the present invention, since the movable terminal has the spring structure with both ends supported, a stronger spring force can be obtained as well as the spring function reliability of the movable terminal can be improved drastically.

Moreover, since the contacting parts of the fixed terminal and the movable terminal have the sliding function, reliability in contact and connection between the terminals can be improved drastically.

Furthermore, since the movable part with a both ends supported configuration is formed integrally, and formed integrally with the case, the spring structure supported on both ends can be formed economically and the assembly accuracy can be improved.

Moreover, since the movable terminal and the fixed terminal are provided opposite to each other, the movable terminal and the fixed terminal need not be provided with a vertical long distance, and thus a drastic small size of the coaxial connector can be realized.

Since the connecting end parts of the movable terminal, the fixed terminal and the external terminal are provided substantially flush with the rear surface of the case, a surface mount type coaxial connector can be obtained easily.

Moreover, since the flat part of the external terminal is formed on the upper surface of the case, mount with an automatic mounting machine can be conducted easily.

Furthermore, since a through cylinder is formed on the upper surface of the external terminal, stable and secure connection with the counterpart coaxial connector can be achieved.

Moreover, since the movable terminal, the fixed terminal and the external terminal and the case are formed integrally, the case and the terminals can be assembled simultaneously with the production of the case and thus the production cost can be reduced.

What is claimed is:

1. A coaxial connector comprising:

an insulating case provided with a concave part for introducing a central contact of a counterpart coaxial connector, a fixed terminal and a movable terminal provided in the concave part of the insulating case, projecting in a direction substantially perpendicular to an introduction direction of the central contact, and an external terminal provided outside the case, wherein the movable terminal has a spring movable part with both ends supported and a central part having a displaceable spring property, and a contacting part linked with the spring movable part integrally, and when the counterpart coaxial connector is not mounted, the contacting part of the movable terminal is contacted and connected with a contacting part of the fixed terminal by being forced in a direction opposite to the introduction direction of the central contact by the spring property of the spring movable part, and the central part of the spring movable part is separated from a bottom surface side of the concave part, when the counterpart coaxial connector is mounted, the central part of the spring movable part is pressed onto the bottom surface side of the concave part by the central contact introduced into the concave part so that the contacting part of the movable terminal is dissociated from the contacting part of the fixed terminal and the movable terminal is electrically connected with the central contact and the external terminal is contacted and connected with an external conductor of the counterpart coaxial connector.

2. The coaxial connector according to claim 1, wherein the movable terminal comprising of a metal plate has spring supporting parts provided on both ends of the spring movable part and a base part formed parallel to the spring movable part, and wherein the base part links a pair of the spring supporting parts and the spring supporting parts are embedded and fixed in the case.

3. The coaxial connector according to claim 2, wherein the spring movable part is formed in an arc-like curved state by bending the base part of the movable terminal.

4. The coaxial connector according to claim 2, wherein the spring supporting parts are positioned by an inner wall surface of the concave part of the case.

5. The coaxial connector according to claim 3, wherein the spring supporting parts are positioned by an inner wall surface of the concave part of the case.

6. The coaxial connector according to claim 1, wherein the contacting part of the fixed terminal has an inclined surface with respect to the contacting part of the movable terminal with a predetermined angle, and the contacting part of the movable terminal is linearly contacted with the inclined surface of the fixed terminal for sliding the same.

7. The coaxial connector according to claim 2, wherein the contacting part of the fixed terminal has an inclined surface with respect to the contacting part of the movable terminal with a predetermined angle, and the contacting part of the movable terminal is linearly contacted with the inclined surface of the fixed terminal for sliding the same.

8. The coaxial connector according to claim 3, wherein the contacting part of the fixed terminal has an inclined surface with respect to the contacting part of the movable terminal with a predetermined angle, and the contacting part of the movable terminal is linearly contacted with the inclined surface of the fixed terminal for sliding the same.

9. The coaxial connector according to claim 4, wherein the contacting part of the fixed terminal has an inclined surface with respect to the contacting part of the movable terminal with a predetermined angle, and the contacting part of the movable terminal is linearly contacted with the inclined surface of the fixed terminal for sliding the same.

10. The coaxial connector according to claim 5, wherein the contacting part of the fixed terminal has an inclined surface with respect to the contacting part of the movable terminal with a predetermined angle, and the contacting part of the movable terminal is linearly contacted with the inclined surface of the fixed terminal for sliding the same.

11. The coaxial connector according to claim 3, wherein the contacting part of the fixed terminal and the contacting part of the movable terminal are provided so as to project from positions substantially opposite to each other on the inner wall surface of the concave part of the case to a position away from an inner bottom surface of the concave part by a predetermined distance.

12. The coaxial connector according to claim 3, wherein the case has a substantially rectangular parallelopiped shape, lead parts formed integrally with the movable terminal and the fixed terminal are bent around to a lower side of the case so as to form first connecting end parts substantially flush with a rear surface of the case, and the external terminal being a plate-like member and having a substantially U-shaped cross-section with respect to a longitudinal direction is adhered to the case, wherein the external terminal has a central flat part disposed on an upper surface of the case and bent parts provided on both sides of the central flat part, the central flat part being provided with a through cylinder to be fitted with the external conductor of the counterpart coaxial connector for introducing the central contact into the concave part of the case and the bent parts being bent around to the lower side of the case and extending along an outer surface of side walls of the case so as to form second connecting end parts substantially flush with the rear surface of the case.

13. The coaxial connector according to claim 3, wherein the case and the terminals are formed integrally.

* * * * *